US007956267B2

(12) United States Patent
Chen

(10) Patent No.: US 7,956,267 B2
(45) **Date of Patent: *Jun. 7, 2011**

(54) HI-HAT SYSTEM

(76) Inventor: Kuo-Chang Chen, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/613,505

(22) Filed: Nov. 5, 2009

(65) Prior Publication Data

US 2011/0100195 A1 May 5, 2011

(51) Int. Cl.
*G10D 13/02* (2006.01)

(52) U.S. Cl. ..... 84/422.1; 84/422.2; 84/422.3

(58) Field of Classification Search ..... 84/421, 84/422.1, 422.2, 422.3
See application file for complete search history.

(56) References Cited

U.S. PATENT DOCUMENTS 6,096,958 A * 8/2000 Liao ..... 84/422.3
* cited by examiner

*Primary Examiner* — Kimberly R Lockett

(57) ABSTRACT

A hi-hat system of the present invention includes a support element, a connecting shank, a fixation element and a transmission element. The support element has a pedal and a rotatable axle. The axle inserts through the connecting shank and the fixation element in a rotational operative relationship. The transmission element connects between the pedal and the connecting shank. The fixation element is adapted to control a movement of an upper cymbal. The connecting shank has a longitudinal slot. The axle is movable between both ends of the longitudinal slot so that the distance between the axle and the transmission element is adjustable, further changing the drive ratio of the axle and the transmission element. As such, the percussion sensitivity of the cymbals is adjustable for the player to achieve better performance effect.

7 Claims, 5 Drawing Sheets

HI-HAT SYSTEM

BACKGROUND OF THE INVENTION

1. Field of the Invention

The present invention relates to a pedal system for a percussion instrument, and more particularly to a hi-hat system.

2. Description of the Prior Art

A hi-hat system plays an important role in the percussion instrument performance. The hi-hat system mainly includes a pedal system for the player to step upon to further percuss the cymbals.

Since the pedal system affects the percussion sensitivity of the cymbals, U.S. Pat. No. 6,399,866 provides a percussion instrument with pedal system having interchangeable cam elements. '866 introduces a sprocket and hub assembly being provided with a detachable cam element. In order to adjust the percussion sensitivity of the cymbals, the player may change a cam element with different cam profile. However, such replacement procedure is still inconvenient for the players, and it is also inconvenient to carry an entire series of cam elements.

SUMMARY OF THE INVENTION

The main object of the present invention is to provide a hi-hat system whose percussion sensitivity of cymbals is easily adjustable.

To achieve the above and other objects, a hi-hat system of the present invention includes a support element, a connecting shank, a fixation element and a transmission element. The support element has a pedal and a rotatable axle. The axle inserts through the connecting shank and the fixation element in a rotational operative relationship. The transmission element connects between the pedal and the connecting shank. The fixation element is adapted to control a movement of an upper cymbal. The connecting shank has a longitudinal slot. The axle is movable between both ends of the longitudinal slot so that the distance between the axle and the transmission element is adjustable, further changing the drive ratio of the axle and the transmission element. As such, the percussion sensitivity of the cymbals is adjustable for the player to achieve better performance effect.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
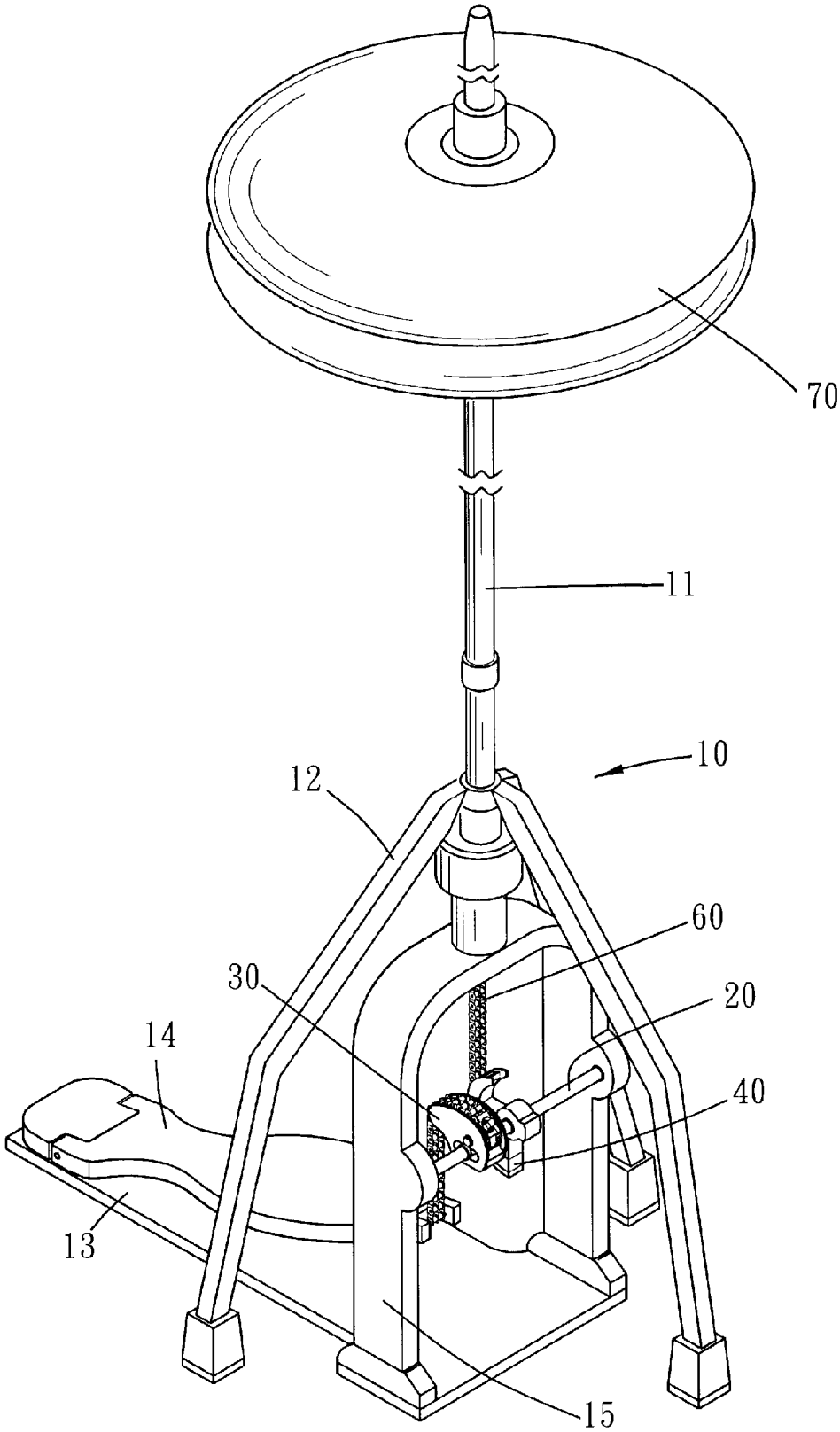
FIG. 1 is a perspective drawing showing a hi-hat system of the present invention.

Please refer to FIG. 1. A hi-hat system of the present invention includes a support element 10. The support element

10 includes a support tube 11, a leg set 12 and a pedal base 13. The support tube 11 and the pedal base 13 mainly locate at a center of the leg set 12.

Figure 2:
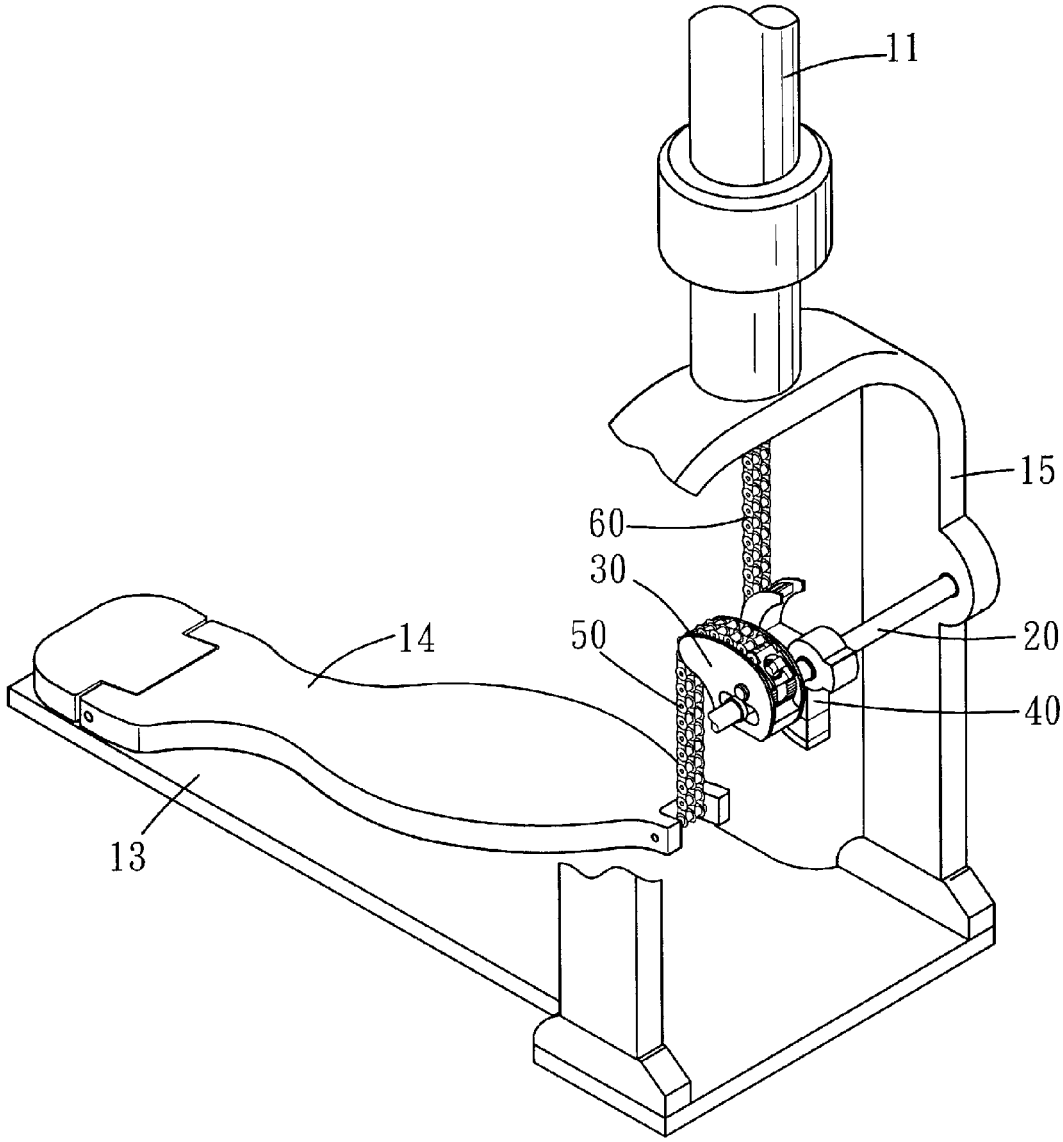
FIG. 2 is an enlarge drawing showing a hi-hat system of the present invention.

Please refer to FIG. 2. The support element further includes a pedal 14 pivotably on the pedal base 13, in which the pedal 14 is swayable between a release position and a percussion position. Two upright frames 15 are disposed on a side of the pedal base 13, and an axle 20 is rotatably disposed between distal ends of the upright frames 15. Note that the axle 20 can also be supported by a single upright frame. The axle 20 inserts through a connecting shank 30 and a fixation element 40 in a rotational operative relationship, e.g. the axle 20 may have a non-circular profile for the shank 30 and the fixation element 40 to engage therewith.

Figure 3:
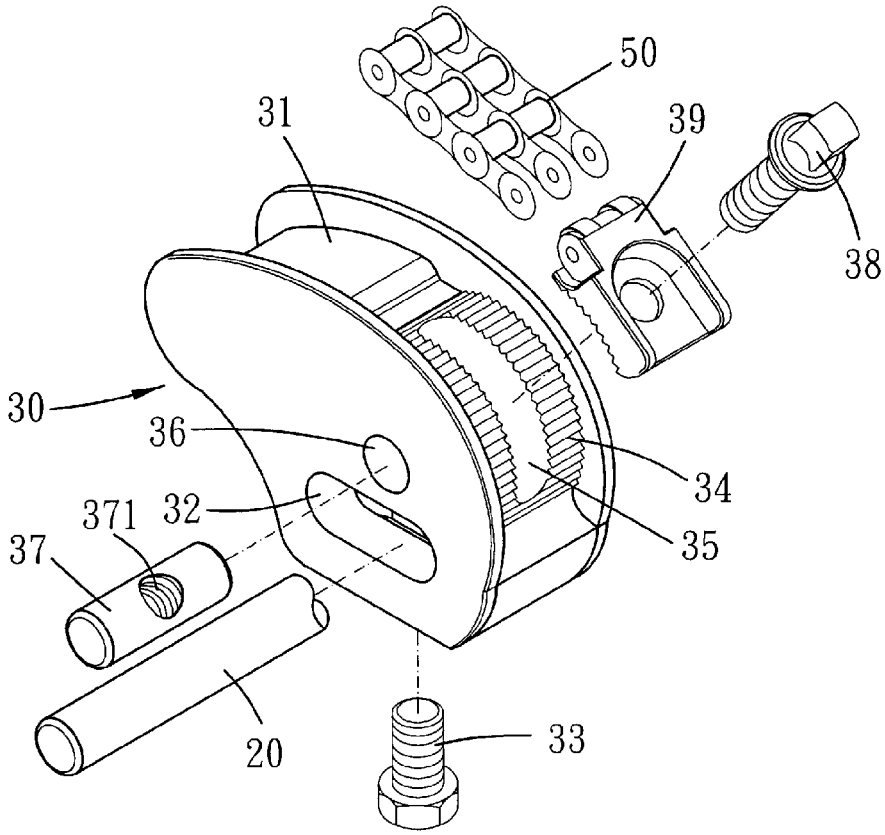
FIG. 3 is a breakdown drawing showing a connecting shank of the present invention.
Figure 3A:
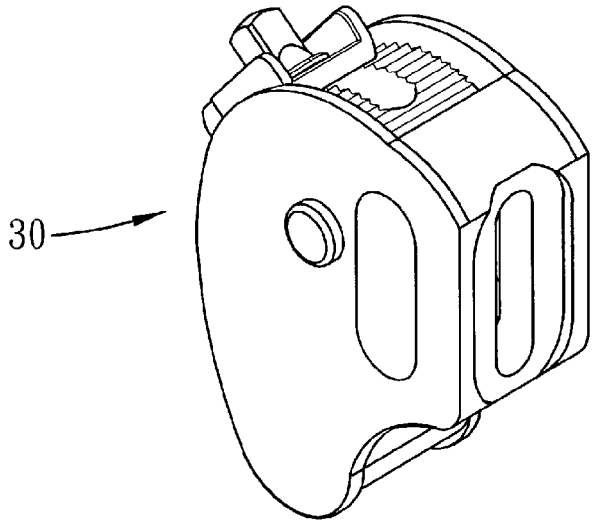
FIG. 3A is a perspective drawing showing a connecting shank of the present invention at another angle of view.

Please refer to FIG. 3. The connecting shank 30 is formed with a working surface 31 radially surrounding the axle 20. The connecting shank 30 has a longitudinal slot 32 transversely disposed thereon for the axle 20 to insert therethrough. Specifically, the length of the slot 32 is bigger than the dimension of the axle 20 so that the axle 20 is movable between both ends of the longitudinal slot 32. Please refer to FIG. 3 and FIG. 3A. The connecting shank 30 further has a positioning unit including a positioning groove (as shown in FIG. 3A) and an engaging element 33. The positioning groove communicates with the slot 32 and extends between both ends of the slot 32. The axle 20, on the other hand, has a threaded bore, and the engaging element 33 inserts through the positioning groove and selectively threadedly engages with the threaded bore of the axle 20 to fix the relative position of the longitudinal slot 32 and the axle 20.

Please refer to FIG. 3. The connecting shank 30 further has an arc surface 34 where a sectorial slot 35 is vertically disposed thereon. The connecting shank 30 also has a connecting bore 36 transversely disposed thereon. The connecting bore 36 communicates with the sectorial slot 35 and locates at a tip of the sectorial slot 35. A rod 37 inserts in the connecting bore 36 and has a threaded bore 371 radially disposed thereon. The connecting shank 30 has a screw unit 38 to connect to a transmission element 50. The screw unit 38 inserts through the sectorial slot 35 to engage with the threaded bore 371. An engaging body 39 is disposed between the screw unit 38 and the arc surface 34. The engaging body 39 and the arc surface 34 are formed with lateral teeth to abut against each other. As such, the engaging body 39 is slidable with respect to the arc surface 34 until the screw unit 38 forces the engaging body 39 to tightly abut against the arc surface 34, adjusting an elevation angle of the pedal 14 as the pedal 14 is at the release position.

Please refer to FIG. 2. The transmission element 50 connects to the pedal 14 at one end thereof and connects to the connecting shank 30 at another end thereof Specifically, the transmission element 50 connects to either the screw unit 38 or the engaging body 39. Thereby, the pedal 14 and the connecting shank 30 are in a motional operative relationship. The transmission element 50 may be a chain 50, as shown in the drawings, or a belt.

Figure 4:
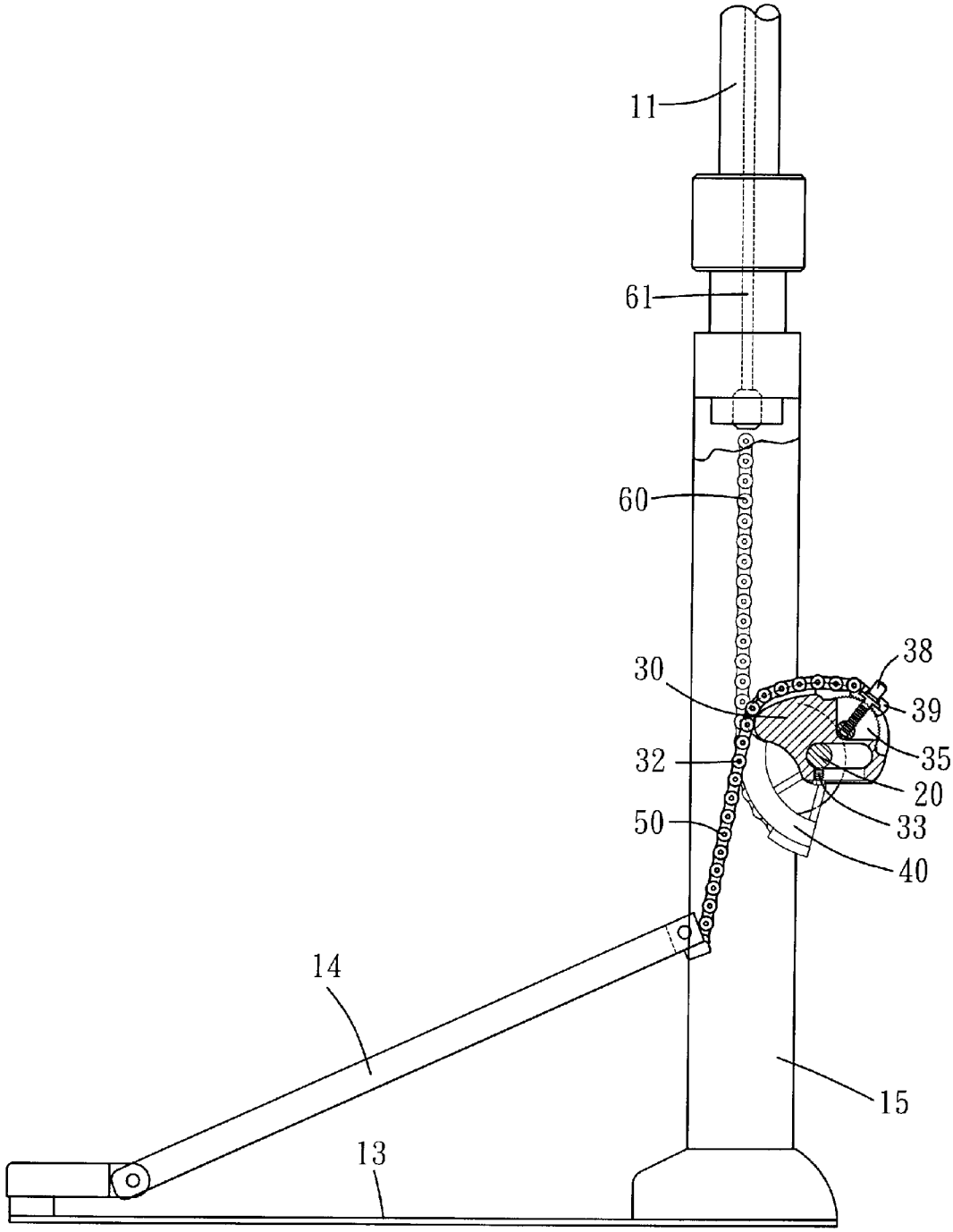
FIG. 4 is a lateral view showing a hi-hat system of the present invention.

Please refer to FIG. 1 and FIG. 4. The fixation element 40 connects to an end of a sub-transmission element 60, and another end of the sub-transmission element 60 connects to a lower end of a movable rod 61, which inserts through the support tube 11. As such, the movable rod 61 is vertically movable as the fixation element 40 rotates. A means is provided for returning the pedal 14 back to the release position. The returning means may include a resilient element (not shown) which can be disposed between the support tube 11 and the movable rod 61. Note that it is possible to install the returning means on the axle 20, the connecting shank 30, the fixation element 40, the transmission element 50 or the pedal 14 other than between the support tube 11 and the movable rod 61. A pair of cymbals 70 are disposed on distal ends of the movable rod 61 and the support tube 11. More specifically, the pair of cymbals includes a lower cymbal disposed on the distal end of the support tube 11 and an upper cymbal disposed on the distal end of the movable tube 61. The cymbals 70 can percuss each other to make sounds as the movable rod 61 is vertically driven, i.e. when the player steps upon the pedal 14.

Figure 5:
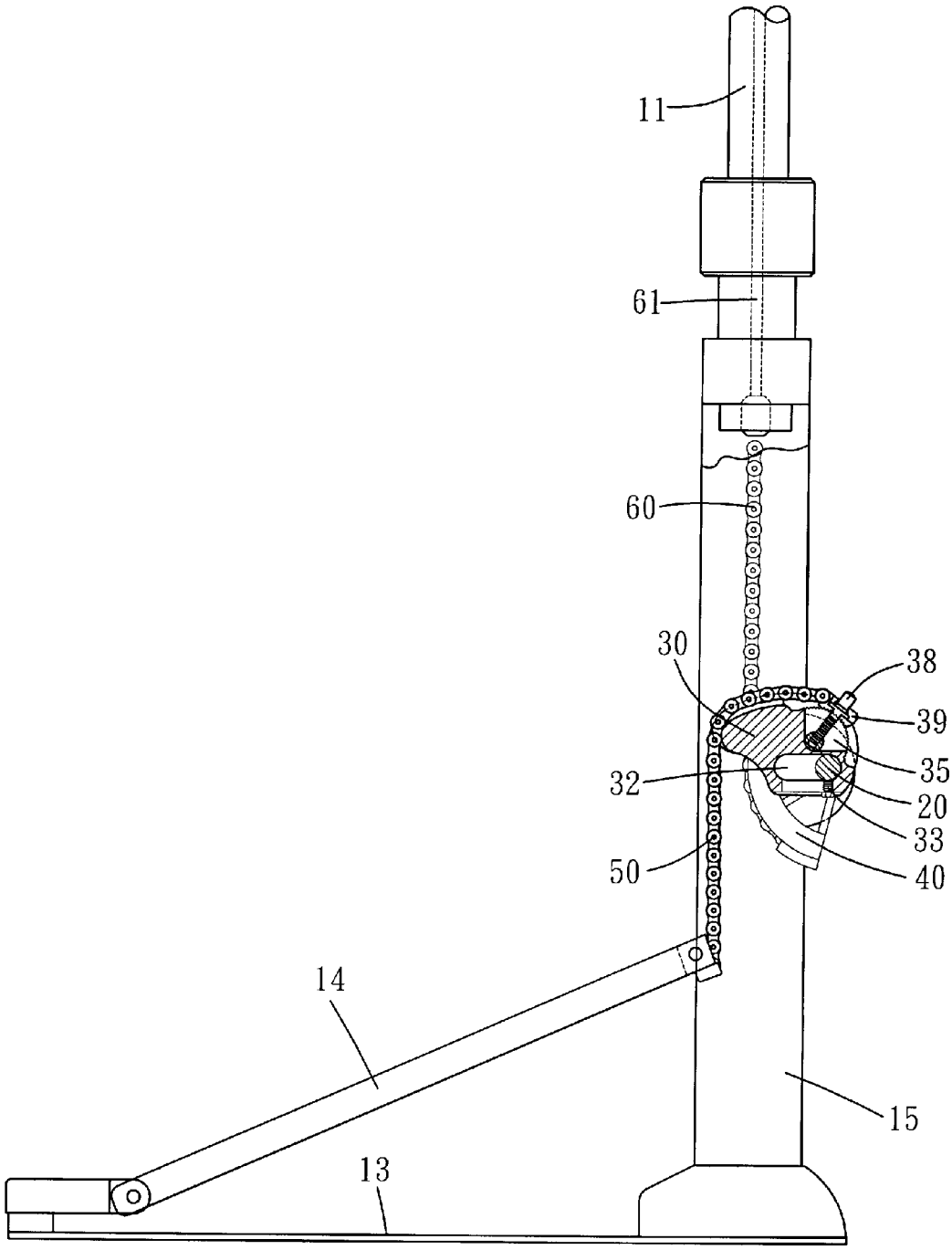
FIG. 5 is a lateral view showing a hi-hat system of the present invention.

Please refer to FIG. 4 and FIG. 5. Since the connecting shank 30 is movable with respect to the axle 20, the distance between the axle 20 and the transmission element 50 is adjustable, further controlling the drive ratio of the axle 20 and the transmission element 50. Also, due to the engaging body 39 being slidable with respect to the arc surface, the elevation angle of the pedal 14 is adjustable as well. As such, the hi-hat system can be accurately tuned to meet the player's tendency, so as to achieve a better performance effect.

What is claimed is:

1. A hi-hat system, comprising:

a support element, having a pedal and at least one upright frame, the pedal being swayable between a release position and a percussion position, an axle being rotatably disposed on the upright frame;

a connecting shank, having a longitudinal slot for the axle to insert therethrough, the longitudinal slot having a first end and a second end for the axle to move therebetween, the connecting shank further having a working surface radially surrounding the axle;

a fixation element, disposed on the axle in a rotational operative relationship, the fixation element being adapted to control a movement of an upper cymbal;

a transmission element, connecting between the pedal and the connecting shank, the transmission element overlapping at least a part of the working surface, the connecting shank being rotatable as the pedal pivoting between the release position and the percussion position.

2. The hi-hat system of claim 1, wherein the connecting shank has a sectorial slot vertically disposed thereon and a connecting bore transversely disposed thereon, the connecting bore communicates with the sectorial slot and locates at a tip of the sectorial slot, a rod inserts in the connecting bore and has a threaded bore radially disposed thereon, a screw unit connects to the transmission element, the screw unit inserts through the sectorial slot to engage with the threaded bore, thereby the screw unit is movable in the sectorial slot and being selectively fixed to adjust an elevation angle of the pedal as the pedal is at the release position.

3. The hi-hat system of claim 2, wherein the connecting shank has an arc surface where the sectorial slot is disposed, an engaging body is disposed between the screw unit and the arc surface, the engaging body is slidable with respect to the arc surface until the screw unit forces the engaging body to tightly abut against the arc surface.

4. The hi-hat system of claim 3, wherein the engaging body and the arc surface are formed with lateral teeth to abut against each other.

5. The hi-hat system of claim 1, wherein the connecting shank further has a positioning unit, the positioning unit selectively fixes a relative position of the longitudinal slot and the axle so that the connecting shank and the axle are in a rotational operative relationship.

6. The hi-hat system of claim 1, further comprising a means for returning the pedal back to the release position.

7. The hi-hat system of claim 1, wherein the fixation element connects to a end of a sub-transmission element, another end of the sub-transmission element connects to a lower end of a movable rod, the upper cymbal is disposed on an upper end of the movable rod, the movable rod is vertically movable as the fixation element rotates.

* * * * *